US005377576A

United States Patent [19]

Good et al.

[11] Patent Number: 5,377,576

[45] Date of Patent: Jan. 3, 1995

[54] DRUM CONSTRUCTION HAVING WOOD AND METAL WALL SECTIONS

[75] Inventors: John J. Good; Donald G. Lombardi, both of Thousand Oaks, Calif.

[73] Assignee: Drum Workshop, Inc., Oxnard, Calif.

[21] Appl. No.: 110,186

[22] Filed: Aug. 20, 1993

[51] Int. Cl.[6] ..... G10D 13/02

[52] U.S. Cl. ..... 84/411 R; 84/413

[58] Field of Search ..... 84/411 R, 412, 413, 84/419, 420

[56] References Cited

U.S. PATENT DOCUMENTS

| | | | |
|---|---|---|---|
| 1,381,494 | 6/1921 | Olsen | 84/411 R |
| 3,911,779 | 10/1975 | Della-Porta | 84/411 R |
| 4,045,264 | 8/1977 | Ludwig et al. | 84/411 R |
| 4,060,019 | 11/1977 | Cordes | 84/411 R |
| 4,060,019 | 11/1977 | Cordes | 84/411 R |
| 4,295,405 | 10/1981 | Sleishman | 84/411 R |
| 4,334,458 | 6/1982 | Grauso | 84/411 R |
| 4,529,865 | 7/1985 | Oakes, Jr. . | |
| 4,630,521 | 12/1986 | Alletto | 84/411 R |
| 4,660,455 | 4/1987 | Jones et al. | 84/411 R |
| 4,903,569 | 2/1990 | Kurosaki | 84/411 R |
| 4,916,995 | 4/1990 | Soler et al. . | |
| 4,928,565 | 5/1990 | Hsieh | 84/411 R |
| 4,993,304 | 2/1991 | Lovelet | 84/411 R |
| 5,025,697 | 6/1991 | May | 84/411 R |

*Primary Examiner*—Michael L. Gellner
*Assistant Examiner*—Cassandra C. Spyrou
*Attorney, Agent, or Firm*—William W. Haefliger

[57] ABSTRACT

A combination composition drum comprising a drum shell having cylindrical sections located in axially end-to-end positions; at least a first section consisting of wood and at least second and third sections consisting of metal; drumhead means on the drum; means for retaining the drumhead means on the drum, including flange means at axial end of the drum, retainer means on one the sections, and adjustable tensioning means interconnecting the flange means and retainer means.

25 Claims, 2 Drawing Sheets

DRUM CONSTRUCTION HAVING WOOD AND METAL WALL SECTIONS

BACKGROUND OF THE INVENTION

This invention relates generally to drum structure, and more particularly to a drum side wall construction characterized as imparting a more desirable audible sound to the drum, when struck by a drum beater, as well as facilitating the different provisions and assembly of related drum lengths or depths.

In the past, drum walls or shells extending between opposite heads or skins were of one-piece construction. This foreclosed selected lengthening of the drum shell; also, there was need for enhancing the sound created by the drum, when struck. Also, no way was known to my knowledge to construct a drum, including a drum shell to provide the advantages in construction, operation and results, as now afforded by the present invention.

SUMMARY OF THE INVENTION

It is a major object of the invention to provide an improved drum, including a drum shell, meeting the above needs and providing advantages as referred to above, as well as additional advantages in construction and use, as will be seen.

Basically, the invention is embodied in a combination composition drum, comprising:

a) a drum shell having cylindrical sections located in axially end-to-end positions, b) at least a first section consisting of wood and at least second and third sections consisting of metal, c) drumhead means on the drum, d) means for retaining the drumhead means on the drum, including flange means, at an axial end of the drum, retainer means on one of the sections, and adjustable tensioning means interconnecting the flange means and retainer means.

As will be seen, the shell three sections are as follows:

—a first wall section consisting of wood

—a second wall section consisting of wood

—a third wall section consisting of metal, and the first section located intermediate the second and third sections.

It is another object of provide pairs of the multiple shell sections with end-to-end interfit, as for example telescopic interfit, the first section having end-to-end interfit with each of the second and third sections. Such interfit is typically characterized by end overlapping annular connections.

A further object is to provide two metallic shell sections, and an intermediate shell third section, the two sections consisting of brass, and the third section consisting of wood such as maple.

The adjustable tension means may advantageously include tensioning fasteners extending oppositely between each of the flange structures and the retainer means, and sidewardly adjacent the multiple shell sections. Additionally, drumhead retention rings are typically provided adjacent said flange structures, the second and third cylindrical metal sections providing beveled edges over which first and second drumheads defined by said drumhead means are stretched.

These and other objects and advantages of the invention, as well as the details of an illustrative embodiment, will be more fully understood from the following specification and drawings, in which:

DRAWING DESCRIPTION

DETAILED DESCRIPTION

Figure 1:
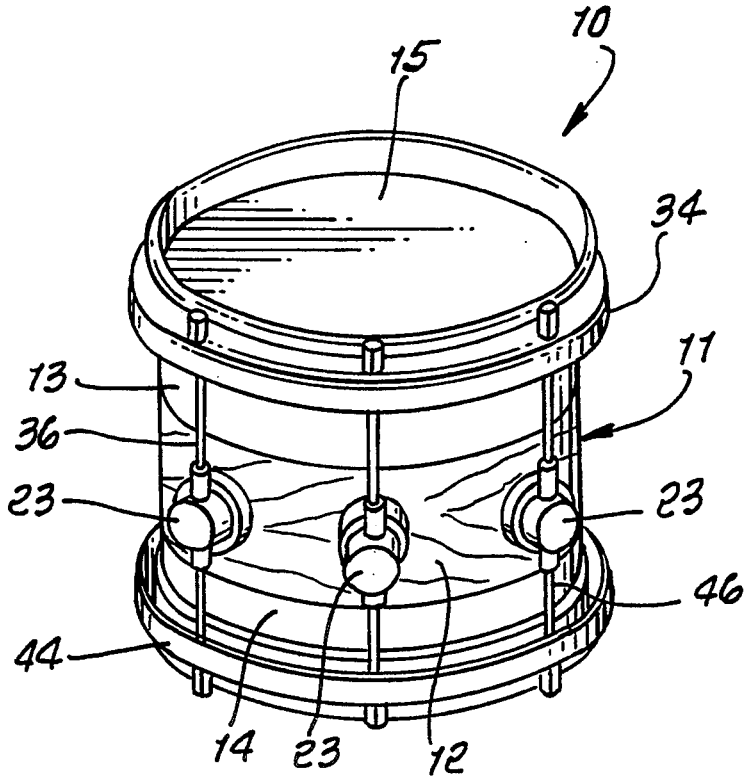
FIG. 1 is a perspective view of a drum incorporating the invention.

In the drawings, a drum 10 has a shell with cylindrical sections located in axially end-to-end position, at least a first section consisting of wood and at least second and third sections consisting of metal. In the example, the shell 11 has a first wall section 12 consisting of wood, a second wall section 13 consisting of metal, and a third wall section 14 consisting of metal. The section 12 is preferably located between sections 13 and 14, so that drumheads 15 and 16 may stretch over annular beveled metallic edges 17 and 18 that do not "weather" or otherwise change with atmospheric or other conditions. For best results, sections 12 and 13 have telescopic interfit with section 11, as for example at radially overlapping portions **12*a* and 13*a*, and radially overlapping portions 12*b* and 14*a*. Such connections are also referred to as "pin and box" connections, providing high radial and axial stability. The highly desirable inserts, sections 13 and 14 consist of brass, and section 12** of maple, and their interfits may be tight.

Means is also provided for retaining the drumhead means on the drum, including flange means at axial end of the drum, retainer means on one of the sections, and adjustable tensioning means interconnecting the flange means and retainer means. In the example, flange structure 20 is provided in association with metal section 13 of the shell, and flange structure 21 in association with metal section 14 of the shell. Retainer elements 23 are spaced about and adjacent the outer surface 24 of wooden section 12, mid-way between metal sections 13 and 14, and the elements 23 may have circular cross sections as shown and consist of brass. The elements 23 carry tubular holders 25 projecting vertically and parallel to the drum axis, but in axially opposite directions. Retention fasteners 26 project radially through the shell section 12 to affix the elements 23 to the outer surface of the section 12. The inner surface **12*c* of the latter is lacquered as at 30** to provide a sound brilliance, together with a "warm center punch" sound.

The upper flange structure 20 has an upwardly extending annular rim portion 32 extending above the level of drumhead 15, a medial annular portion 33 extending radially outwardly below the level of 32, for transmitting head tightening loading, and a lower annular portion 34 extending downwardly from the outer extent of 33. A tightening adjustment fastener 36 extends downwardly through 33, and has external threads 37 that interfit rotatably internal threads in upper holder 25. Note fastener head **36*a* bearing on the upper surface of 33. The lower surface of 33 exerts downward loading onto a retention ring 38 to which drumhead 15 is suitably attached, for tightening (or loosening) same, by drawing the head over 17**.

Likewise, lower flange structure 21 has a downwardly extending annular rim portion 43 extending below the level of drumhead 16, a medial annular portion 44 extending radially outwardly above the level of 42 for transmitting head tightening loading, and an upper annular portion 44 extending upwardly from outer extent of 43. A tightening adjusting fastener 46 extends upwardly through 42, and has external threads 47 that interfit rotatably the internal threads in lower holder 25. Note fastener head 46a bearing on the lower surface of 42. The upper surface of 43 exerts upward loading onto lower retention ring 48 to which drumhead 16 is suitably attached, for tightening (or loosening) same, i.e. over bevel 18. Accordingly, the drumheads are individually adjustable, and the acoustic benefits of having the two flange structures attached to wood, rather than metal, are enabled while the drumheads are stretched over metal edges, with benefits as appear below.

1. In summary, consider the qualities of a brass snare drum.

a) The brilliance of definition from the bearing edge of a brass drum is a very important quality. The rimshots explosive high frequency gives the metallic image of sound;

b) Because most brass drum shells are so thin (i.e. 0.035–0.045), after the crack of the edge sound, one is left with a low timbre tubby sound. This is extremely hard to deal with from day to day because drumheads are so inconsistent. This inconsistency greatly changes the overall color of sound.

c) A way to remedy this problem would be to thicken the brass to raise the timbre value. However, if one thickens the shell dramatically, the brass would be very heavy and the high end "ring" would over-ride the "body" of the drum. The brass band/bearing edges at the top and bottom on the brass/wood drum of the present invention achieve what is needed, sonicly.

2. Understanding maple drums is quite simple. The thicker the shell, the higher the pitch and the thinner the shell the lower the pitch.

a) Lacquering the inside of a thick maple shell gives brilliance, with a warm center punch sound.

b) The bearing edge, if wooden, can alter or deteriorate after a period of time due to weather changes etc. It is critical to have the edge unchanged at all times to insure accurate playability and maximum "pop" value of the wooden shell. This is provided by the metallic beveled edges of the metallic sections attached to the medial wood section.

c) To join the brass qualities and wooden qualities in one drum optimizes desired results. Thus, the machined brass edges provide maximum sensitivity out to the edge of the playing surface, while middle head playing has a very desirable "punch".

Figure 3:
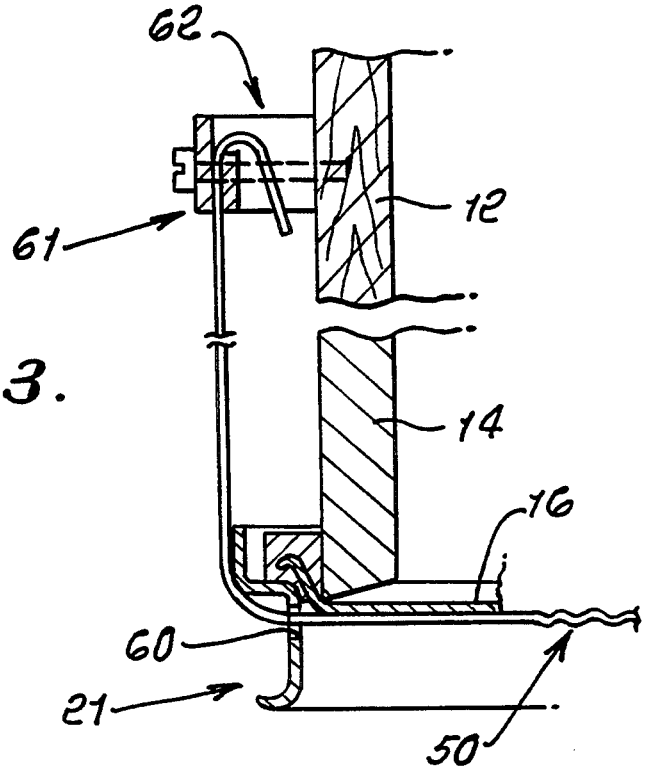
FIG. 3 is a fragmentary view showing an additional attachment to the drum.
Figure 2:
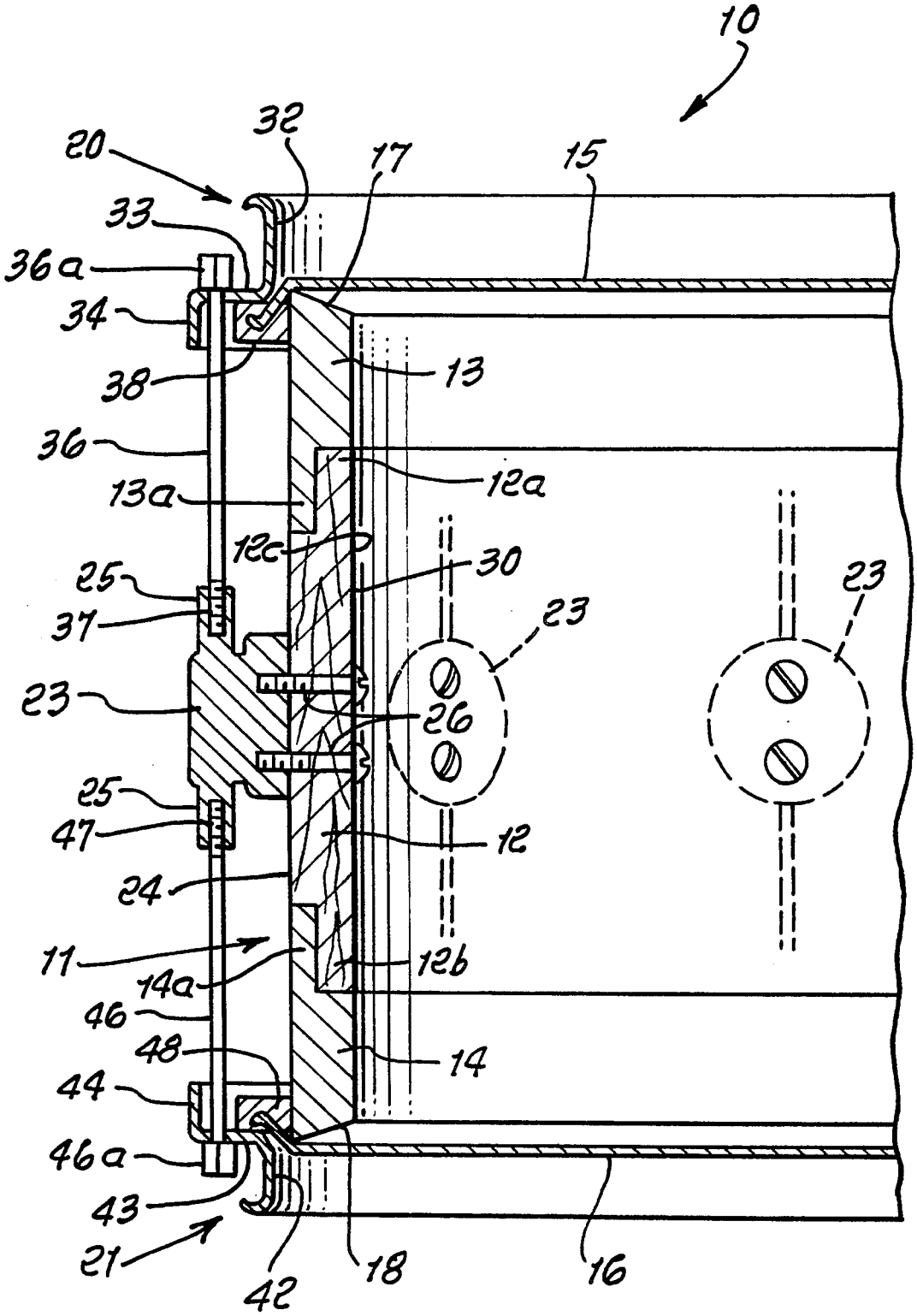
FIG. 2 is a vertical section taken through one side of the drum.

In FIG. 3, a band-like device 50 extends across drumhead 16, through a window 60 in flange structure 21, and upward to a clamp 61 attached at 62 to wooden shell 12. Device 50 consists of parallel rows of spiral wires tensioned adjacent 16 to be struck for creating a scratch sound.

An additional advantage of the shell structure is the fact that wooden section 12 can be made to selected axial length, while still interfitting with metal sections 13 and 14.

I claim:

1. A combination drum structure comprising:

a) a drum shell having cylindrical sections located in axially end-to-end positions, and in direct axial alignment, b) at least a first section of said sections consisting of wood and at least second and third sections of said sections consisting of metal, c) drumhead structure on the drum shell, d) retaining means for retaining said drumhead structure on the drum shell, said means including flange structure at an axial end of the drum shell, retainer structure on one of said sections, and adjustable tensioning structure interconnecting said flange structure and retainer structure, e) and said flange structure being independent of and separate from said sections, and said first section interposed between said second and third sections.

2. The combination of claim 1 wherein pairs of said sections have end-to-end telescopic interfit.

3. The combination of claim 2 wherein said first section has end-to-end telescopic interfit with each of said second and third sections.

4. The combination of claim 2 wherein said end-to-end interfit is an overlapping annular connection.

5. The combination of claim 3 wherein said end-to-end telescopic interfit is an overlapping annular flange connection.

6. The combination of claim 1 wherein said metal of said second and third sections is brass.

7. The combination of claim 1 wherein said flange structure is at ends of said second and third sections, and said retainer structure is adjacent and connected to said first section.

8. The combination of claim 7 wherein said adjustable tensioning structure includes tensioning fasteners extending oppositely between said flange structure and said retainer structure.

9. The combination of claim 8 wherein said retainer structure includes multiple retainers.

10. The combination of claim 8 wherein said second and third cylindrical metal sections provide beveled edges over which said drumhead structure are stretched.

11. The combination of claim 10 wherein said retainer structure includes retention rings which are operatively connected with said flange structure and urged by said flange structure toward said retainer structure.

12. The combination of claim 1 including cured lacquer on the inner surface of the first section.

13. A combination drum comprising:

a) a drum shell having cylindrical sections located in axially end-to-end positions, and in direct axial alignment, b) at least a first section of said sections consisting of wood and at least a second section of said sections consisting of metal, c) drumhead structure on the drum shell, d) retaining means for retaining said drumhead structure on the drum shell, including flange structure at an axial end of the drum shell, retainer structure on one of said sections, and adjustable tensioning structure interconnecting said flange structure and retainer structure, e) and said flange structure being independent of and separate from said sections, said second section interposed between said first section and the drumhead structure.

14. The combination of claim 13 wherein said first section is located adjacent said second section.

15. The combination of claim 13 wherein said sections have end-to-end telescopic interfit.

16. The combination of claim 14 wherein said first section has end-to-end telescopic interfit with said second section.

17. The combination of claim 15 wherein said end-to-end interfit is an overlapping annular connection.

18. The combination of claim 16 wherein said end-to-end telescopic interfit is an overlapping annular flange connection.

19. The combination of claim 14 wherein said metal of said second section is brass.

20. The combination of claim 14 wherein said flange structure is at an end of said second section, and said retainer structure is adjacent and connected to said first section.

21. The combination of claim 20 wherein said adjustable tensioning structure includes tensioning fasteners extending oppositely between said flange structure and said retainer structure.

22. The combination of claim 21 wherein said retainer structure includes multiple retainers.

23. The combination of claim 21 wherein said second cylindrical metal section provides a beveled edge over which said drumhead structure is stretched.

24. The combination of claim 23 wherein said retainer structure includes retention rings which are operatively connected with said flange structure.

25. The combination of claim 13 including cured lacquer on the inner surface of the first section.

* * * * *